United States Patent [19]

Sadler

[11] Patent Number: 4,469,196

[45] Date of Patent: Sep. 4, 1984

[54] FIRE ESCAPE DEVICE

[76] Inventor: Charlton Sadler, P.O. Box 446, Brooksville, Fla. 33512

[21] Appl. No.: 430,962

[22] Filed: Sep. 30, 1982

[51] Int. Cl.[3] ..... A62B 35/00; A62B 1/10

[52] U.S. Cl. ..... 182/236; 182/231; 188/270

[58] Field of Search ..... 182/3, 5, 233, 235, 182/75, 236, 238, 231; 188/270

[56] References Cited

U.S. PATENT DOCUMENTS

| | | | |
|---|---|---|---|
| 197,899 | 12/1877 | Root | 182/238 |
| 514,094 | 2/1894 | Roper . | |
| 849,221 | 4/1907 | Engel . | |
| 2,502,896 | 4/1950 | Sherbrook | 254/160 |
| 2,553,090 | 5/1951 | Holley | 254/160 |
| 3,261,590 | 7/1966 | Bech | 254/160 |
| 3,595,528 | 7/1971 | Virkki | 254/160 |
| 3,760,910 | 9/1973 | Koshihara | 188/180 |
| 3,850,263 | 11/1974 | Chin | 182/5 |
| 3,879,016 | 4/1975 | Kankkunen | 254/158 |
| 3,907,256 | 9/1975 | Kankkunen | 254/160 |
| 3,946,989 | 3/1976 | Tauda | 254/157 |
| 4,000,881 | 1/1977 | Matsumoto | 254/157 |
| 4,018,423 | 4/1977 | Belew | 254/158 |
| 4,029,298 | 6/1977 | Lassche | 254/158 |
| 4,173,332 | 11/1979 | Du Londel | 254/160 |
| 4,198,033 | 4/1980 | Messuziere | 254/159 |

FOREIGN PATENT DOCUMENTS

| | | | |
|---|---|---|---|
| 1498226 | 2/1977 | United Kingdom | 182/5 |

*Primary Examiner*—R. P. Machado

*Attorney, Agent, or Firm*—Stefan Stein

[57] ABSTRACT

A fire escape device enabling a person to escape from a multi-story building. The fire escape device of the invention comprises two sets of planetary gears which operatively interconnect a winding drum to the main shaft of a fan assembly. During operation, as the cable is unwound from the drum, the sets of planetary gears cause the shaft of the fan and correspondingly, the fan blades themselves to rotate at great speed thereby braking and hence controlling the rate at which the cable is released from the winding drum.

2 Claims, 4 Drawing Figures

FIRE ESCAPE DEVICE

BACKGROUND OF THE INVENTION

Field of the Invention

This invention relates to fire escape devices. More particularly, this invention relates to an escape device which enables a person to descend from a building via a cable or other flexible member.

Presently, there exist numerous fire escape devices which enable a person to escape from a multi-story building or the like. U.S. Pat. Nos. 3,879,016 and 3,907,256 issued to Kankkunen; U.S. Pat. No. 3,261,590 issued to Bech et al.; U.S. Pat. No. 2,502,896 issued to Sherbrook et al.; U.S. Pat. No. 849,221 issued to Engel; U.S. Pat. No. 3,595,528 issued to Virkki; U.S. Pat. No. 3,760,910 issued to Koshihara; U.S. Pat. No. 4,029,298 issued to Lassche; U.S. Pat. No. 3,946,989 issued to Tsuda; U.S. Pat. No. 4,000,881 issued to Matsumoto; U.S. Pat. No. 514,094 issued to Roper; U.S. Pat. No. 3,850,263 issued to Chin; U.S. Pat. No. 4,173,332 issued to DuLondel; U.S. Pat. No. 4,018,423 issued to Belew; U.S. Pat. No. 4,198,033; and U.S. Pat. No. 2,553,090 issued to Holley disclose various types of fire escape devices presently known in the trade. One major disadvantage to the majority of such devices, is the requirement of manual exertion to control the weight at which the cable is released from the winding drum, and hence, the rate at which the escaping person descends to the ground. Various hydraulic mechanism are taught which teach the use of a reverse acting hydraulic pump and meter mechanisms which controls the rate of descent.

OBJECT OF THE INVENTION

The object of this invention is to provide a fire escape device which enables a person to effortlessly descend to the ground from a multi-storied building or the like.

SUMMARY OF THE INVENTION

For the purposes of summarizing the invention, the invention is a fire escape device which comprises two or more sets of planetary gears which operatively interconnect a winding drum to the main shaft of a fan assembly. During operation, as the cable is unwound from the drum, the first set of planetary gears functions to rotate an intermediate plate which functions as the base of the second set of planetary gears which is, in turn, geared to the shaft of the fan. This causes the shaft of the fan and correspondingly, the fan blades themselves, to rotate at great speed. With every other fan blade being contoured in the opposite direction to its adjoining fan blade, the rotating set of fan blades create alternating air currents which, in effect, applies resistance to the rotation of the fan blade, thereby controlling the rate at which the cable is released from the winding drum while preventing cavitation. A caliper brake mechanism, common in the trade, may be incorporated about the outer housing of the fan blades to manually prevent rotation of the fan blades and, therefore, prevent further descent.

DESCRIPTION OF PREFERRED EMBODIMENT

Figure 1:
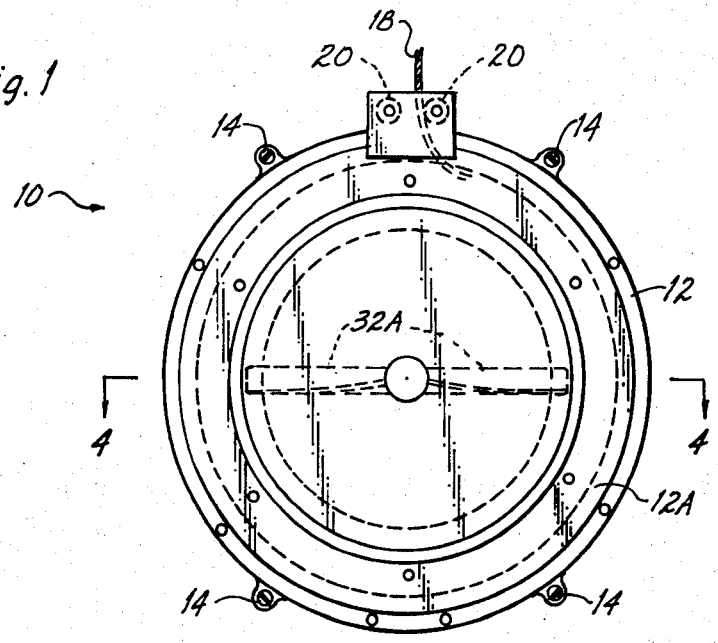
FIG. 1 is a plan view of the fire escape of the invention illustrating the generally disc-shaped housing thereof.
Figure 2:
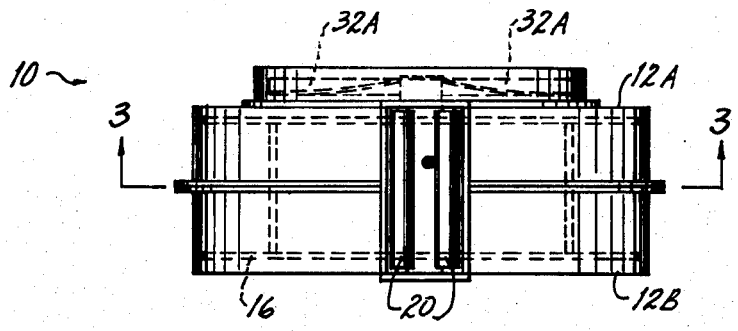
FIG. 2 is a end view of FIG. 1.

Referring to FIG. 1, it is seen that the fire escape 10 of the invention comprises a generally disc-shaped housing 12 composed of a front and rear circular plate 12A and 12B which are affixed together in a spaced apart relationship by four stand off/bolt combinations 14. Contained within the housing 12 is a drum 16 having a relatively large inner diameter. A supply of cable 18 is wound within the U-shaped area of the drum 16. One end of the cable is permanently affixed to the drum 16 and the other end extends through a pair of opposing guide rollers 20 to be affixed to a stationary support. Preferably, the pair of guide rollers 20 extend transversely from the drum 16 such that the cable 18 bears against one of the rollers 20 as it is dispensed from the drum 16. It is noted that another pair of guide rollers 20 may be positioned longitudinally relative to the drum 16 to assure that the cable 18 remains centrally located as it is fed from the drum 16.

Figure 3:
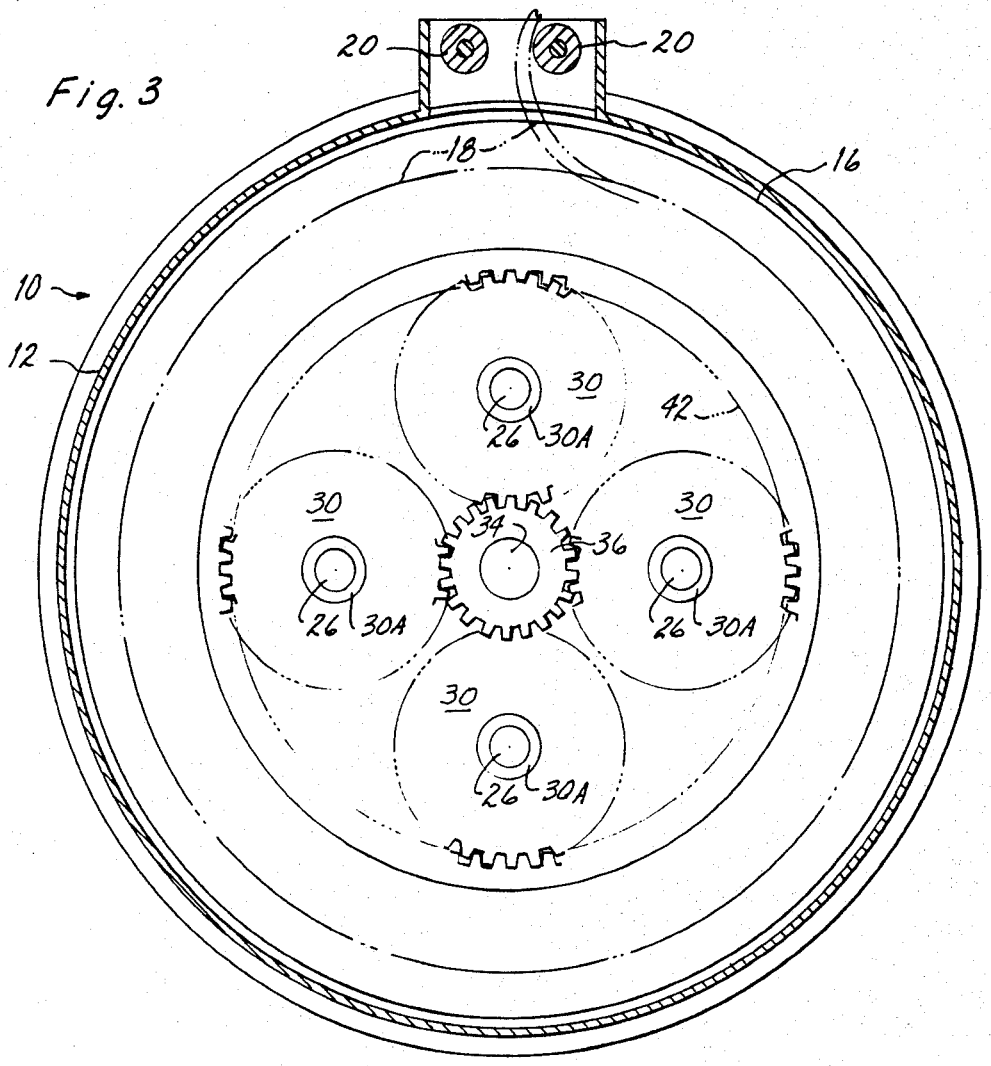
FIG. 3 is a cross sectional view of FIG. 2 along lines 3—3.
Figure 4:
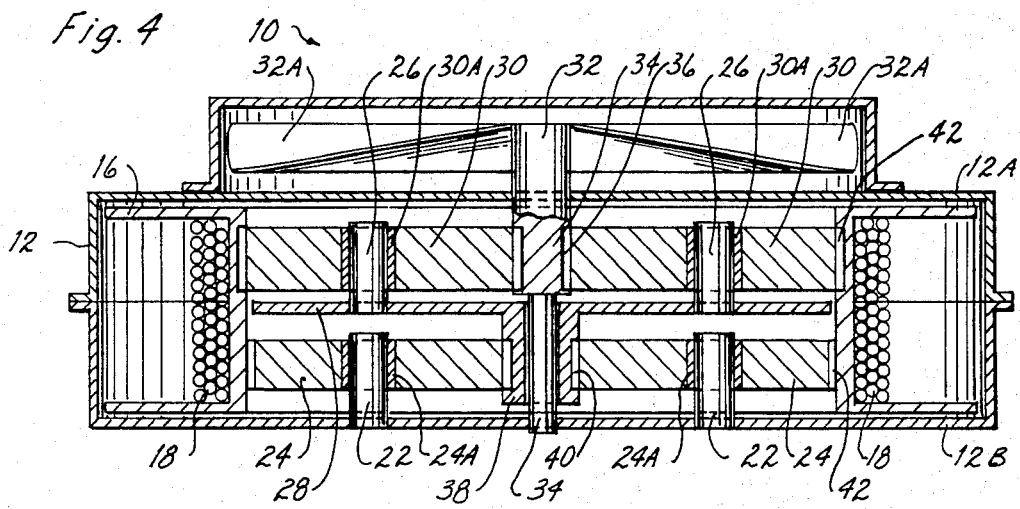
FIG. 4 is a cross sectional view of FIG. 1 along lines 4—4.

Referring to FIGS. 3 and 4, it is seen that two sets of planetary gears are positioned within the inner diameter of the housing 16. The first set of planetary gears comprises four stub shafts 22 which are rigidly fastened to the plate 12B of the housing 12. Four spur gears 24 are rotatably journaled onto the respective stub shafts 12 by means of bearings 24A.

The second set of planetary gears comprises another set of four stub shafts 26 which originally are rigidly connected to an intermediate circular plate 28. Corresponding spur gears 30 are then journaled to the respective stub shafts 26 by means of corresponding bearings 30A. A fan assembly 32 is rigidly connected to a major shaft 34 which extends directly through the center of the two sets of planetary gears. The first portion of the shaft 34 includes gear 36 for geared relationship with the spur gears 30. Another portion of the major shaft 34 rotatably extends to a collar 38 rigidly affixed to the intermediate plate 28. The other circumference of the collar 38 includes gears 40 for geared engagement with the spur gears 24 of the first set of planetary gears. Finally, the inner circumference 42 of the drum 16 is geared for a geared relationship with the spur gears 24 and 30 of both sets of the planetary gears.

During operation, rotation of the drum 16 to dispense cable 18 causes spur gears 24 to rotate which in turn causes intermediate plate 28 to rotate at a high speed. With rotation of the drum 16 causing rotation of the other spur gears 30 and with the high speed of intermediate plate 28, major shaft 34 is caused to rotate at an extremely high rotational speed. It is noted that a plurality of sets of the above described planetary gears may be cascaded to further increase the rotating speed of the major shaft 34.

The fan assembly 32 preferably comprises at least two fan blades 32A which are contoured in reverse directions with respect to one another. This creates a high speed reversal of the airflow immediately around the fan assembly 32, thereby eliminating any cavitation problems.

I claim:

1. A fire escape device, comprising in combination:

a drum;

a length of cable wound on said drum;

a fan assembly; and a first and a second set of planetary gears operatively connected between said drum and said fan assembly to cause the blades of said fan assembly to rotate at great speed upon rotation of said drum, said first set of planetary gears comprising a plurality of first stub shafts rigidly connected to said housing and a corresponding plurality of first spur gears rotatably journaled on said first stub shafts for geared engagement with said drum and said second set of planetary gears comprising an intermediate plate for geared engagement with said first spur gears, a plurality of second stub shafts rigidly affixed to said intermediate plate, and a corresponding plurality of second spur gears rotatably journaled on said second stub shafts for geared engagement with said drum and said fan assembly, whereby upon rotation of said drum during the unwinding of said cable therefrom, said first and second sets of planetary gears operatively causes the blade of said fan assembly to rotate at great speed.

2. The fire escape device as set forth in claim 1, wherein said fan assembly comprises at least two fan blades which are contoured in reverse directions such that reverse air currents are created as said fan blades are rotated.

* * * * *